US006932594B2

(12) United States Patent
Weclas et al.

(10) Patent No.: US 6,932,594 B2
(45) Date of Patent: Aug. 23, 2005

(54) METHOD AND DEVICE FOR LOW-EMISSION NON-CATALYTIC COMBUSTION OF A LIQUID FUEL

(75) Inventors: Miroslaw Weclas, Langensendelbach (DE); Jochen Volkert, Pommelsbrunn (DE)

(73) Assignee: GVP Gesellschaft zur Vermarktung der Porenbrennertechnik mbH, Erlangen (DE)

( * ) Notice: Subject to any disclaimer, the term of this patent is extended or adjusted under 35 U.S.C. 154(b) by 0 days.

(21) Appl. No.: 10/478,799

(22) PCT Filed: Jun. 3, 2002

(86) PCT No.: PCT/EP02/06063

§ 371 (c)(1),
(2), (4) Date: Dec. 23, 2003

(87) PCT Pub. No.: WO02/099334

PCT Pub. Date: Dec. 12, 2002

(65) Prior Publication Data

US 2004/0170936 A1 Sep. 2, 2004

(30) Foreign Application Priority Data

Jun. 2, 2001 (DE) ..... 101 27 043

(51) Int. Cl.[7] ..... F23D 3/40

(52) U.S. Cl. ..... 431/7; 431/170; 431/328; 431/11; 431/215; 431/346

(58) Field of Search ..... 431/7, 170, 328, 431/11, 215, 346

(56) References Cited

U.S. PATENT DOCUMENTS

| | | | | |
|---|---|---|---|---|
| 4,318,689 A | | 3/1982 | Forster et al. | |
| 5,154,599 A | * | 10/1992 | Wunning | 431/215 |
| 5,165,884 A | * | 11/1992 | Martin et al. | 431/7 |
| 5,197,871 A | | 3/1993 | Yamamoto et al. | |
| 5,624,252 A | * | 4/1997 | Charles et al. | 431/7 |
| 6,257,868 B1 | * | 7/2001 | Durst et al. | 431/7 |

FOREIGN PATENT DOCUMENTS

| | | |
|---|---|---|
| DE | 335 316 C | 3/1921 |
| DE | 44 01 799 C1 | 6/1995 |
| DE | 196 46 957 A1 | 5/1998 |
| DE | 199 04 489 A1 | 9/1999 |
| DE | 199 37 921 A1 | 2/2001 |
| DE | 199 39 951 A1 | 3/2001 |

* cited by examiner

*Primary Examiner*—Stephen Gravini
(74) *Attorney, Agent, or Firm*—Rankin, Hill, Porter & Clark LLP

(57) ABSTRACT

A method and device for low-emission, noncatalytic combustion of a liquid fuel. The method includes separately introducing the liquid fuel in a non-ignitable state into a mixing zone, vaporizing the liquid fuel in the mixing zone, separately introducing a gaseous oxidizing agent into the mixing zone, and mixing the fuel and the gaseous oxidizing agent in the mixing zone to create ignitable mixture. The mixing zone is formed so that combustion is not possible even when the ignition temperature of the mixture is reached within the mixing zone. Combustion of the mixture occurs in a combustion zone located down current from the mixing zone.

32 Claims, 3 Drawing Sheets

METHOD AND DEVICE FOR LOW-EMISSION NON-CATALYTIC COMBUSTION OF A LIQUID FUEL

Figure 1:
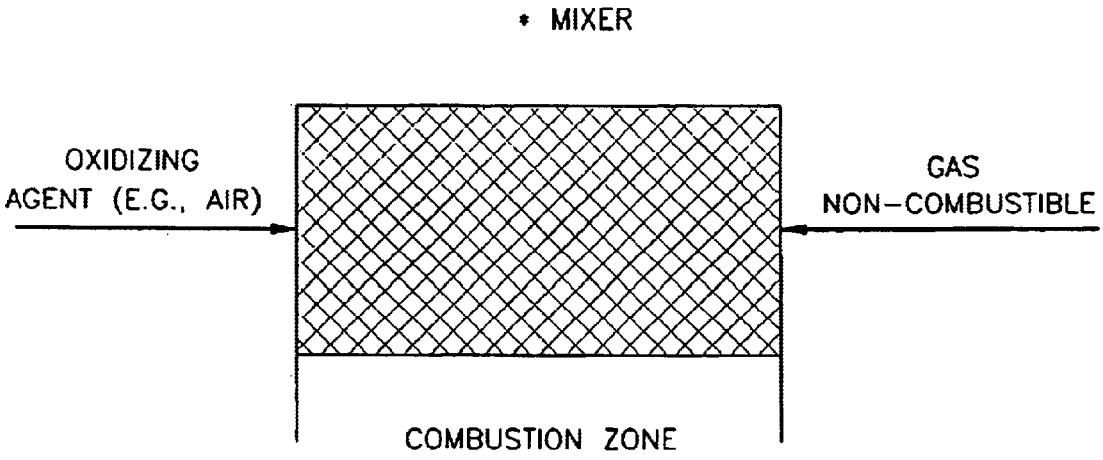

The invention relates to a method and a device for low-emission, non-catalytic combustion of a liquid fuel.

From the state of art a burner is known from DE 43 22 109 A with which an ignitable gas/air mixture is fed to a chamber located in front of a pore body. The porosity of the pore body is formed so that a backfire of a flame in the chamber is not possible. However, it cannot be excluded that an ignition may take place in the chamber for another reason and thus destroy burner.

The subsequently published DE 100 42 479 A1 discloses a device and a method for the catalytic oxidizing of fuels. With this, fuel and air are fed to a mixing area which is followed by a catalytic converter. Due to damage to the catalytic converter, for example, an undesired ignition may occur in the mixing area.

DE 195 44 417 A1 describes a catalytic burner for the combustion of fuel gas, in particular hydrogen. With this, the fuel gas and the air are fed separately into a porous catalytic converter element. The mixture and the combustion take place simultaneously in the catalytic converter element. Sometimes a homogenous mixture of fuel gas and air is not achieved. The combustion is not always complete.

DE 196 46 957 A1 describes a further burner which is suitable for the combustion of liquid fuel. With this, a mixture consisting of atomized liquid fuel and air is fed into a pore body. The pore body is formed in its porosity so that combustion of the mixture can take place therein. The mixture is moved over a flame arrester to a further pore body which is positioned down current with a Péclet number of >65 and is burned there. The known burner has a relatively low performance dynamic, i.e., it can-only be modulated within a narrow performance range. During operation, high temperatures occur on the jet outlet of the vaporization jet. Deposits are generated there which hinder uniform atomization-of the liquid fuel. This then detracts from as low-emission a combustion as possible.

The object of the invention is to eliminate the disadvantages based on the state of art. In particular, it is to be specified a method and a device which permit as residue-free combustion as possible within a wide performance range. In particular, the goal of the invention is to specify a burner with high modulation capacity which permits particularly low-emission combustion in every performance range.

This object is solved by the features of claims 1 and 12. Useful embodiments of the invention result from the features of claims 2 to 11 and 13 to 23.

In accordance with an initial solution provided by the invention, a method for low-emission, non-catalytic combustion of a liquid fuel is provided consisting of the following steps:

1.1 Separate introduction of the liquid fuel in a non-ignitable status into a mixing zone, 1.2 vaporization of the liquid fuel in the mixing zone, 1.3 separate introduction of a gaseous oxidizing agent into the mixing-zone, 1.4 mixing the fuel and the gaseous oxidizing agent in the mixing zone so that an ignitable mixture is created, wherein the mixing zone is formed so that combustion is not possible even when the ignition temperature of the mixture is reached within the mixing zone, and 1.5 combustion of the mixture in a combustion zone located down current from the mixing zone.

The vaporization of the liquid fuel in the mixing zone permits the construction of a particularly compact burner.

With this, it is ensured that the fuel produced by the vaporization does not come in contact with the oxidizing gas until the mixing zone and an ignitable mixture can thus not be formed until then.

In accordance with a second solution provided by the invention, a method for low-emission, non-catalytic combustion of a liquid fuel is provided consisting of the following steps:

2.1 Vaporization of the liquid fuel in a vaporizer, 2.2 separate introduction of the vaporized fuel in a non-ignitable state into a mixing zone located down current from the vaporizer, 2.3 separate introduction of a gaseous oxidizing agent into the mixing zone, 2.4 mixing the fuel and the gaseous oxidizing agent in the mixing zone so that an ignitable mixture is created, wherein the mixing zone is formed so that combustion is not possible even when the ignition temperature of the mixture is reached within the mixing zone, and 2.5 combustion of the mixture in a combustion zone down current from the mixing zone.

The suggested methods permit a low-residue combustion over a wide performance range. The separate introduction of the fuel and the gaseous oxidizing agent into a mixing zone permits separate control and regulation of the mass flow of both the gas and the gaseous oxidizing agent. This can be used to set a mixture in every desired performance range which allows low-emission combustion. The term "fuel" is primarily used to mean liquid fuel such as light heating oil and similar but also vaporized liquid fuels such as alcohol, benzine or heating oil fumes. Further, the term "fuel" is also used to mean mixtures of flammable and non-flammable gases or of nonflammable gases and flammable fumes.

Since the mixing zone is formed so that a combustion is not possible even when the ignition temperature of the mixture is reached within the mixing zone, the method is particularly safe. Also when one of the combustion zones, for example of fulfilling pore bodies, is damaged, the mixing zone reliably prevents a flame backfire in a line feeding in the fuel. The mixing zone is clearly defined spatially. This means that a homogenous and complete mixture of the mixture can be achieved. —Both solutions provided by the invention have in common that the mixture is created first in the mixing zone and then the mixture is burned in the combustion zone which is separated spatially from the mixing zone. Mixing and combustion do not take place simultaneously in the same zone.

It is possible that the mixing zone has a Péclet number of less than 65+/−25, preferably 65. Due to the definition of the Péclet number and the criteria for the selection of a suitable Péclet number, reference is made to DE 43 22 109 A1 whose disclosed contents are herewith included. The suggested method is particularly safe. Due to the separate and immediate introduction of the fuel and the gaseous oxidizing agent into the mixing zone, an ignition of same is reliably prevented until complete formation of the mixture.

The mixing zone can be generated from a perforated plate, a first porous element or also a narrow slit. It has been shown to be advantageous that the mixture is fed toga second porous element which creates the combustion zone and is burned under formation of a flame in its pore volume. Such a combustion is particularly homogenous and low in emission. The perforated plate and/or the first and/or the second Porous element can be made of a ceramic. However, the first and/or second porous element can also be made of an open-pore metal foam, metal braiding or a pile of ceramic bodies, preferably balls.

The first and the second porous elements can be located lying directly next to each other. In this case, a direct heat conductance from the second porous element to the first porous element is possible. The thus caused heat of the first porous element contributes further to the generation of a particularly homogenous mixture.

During vaporization, a non-oxidizing gas can be added. This can reduce the ignitability of the vaporized fuel.

It is possible that the mass flow of the fuel led to the mixing zone and/or the mass flow of the gaseous oxidizing agent are controlled. Each of the two mass flows can thereby be controlled separately or also regulated in dependence on a specified capacity or a specified amount of emission. Such a regulation can be automated using microprocessors following a specified program.

Further, it has been shown to be useful that the fuel and/or the gaseous oxidizing agent is/are preheated. For preheating, the exhaust generated during combustion can be added to the vaporized fuel and/or the gaseous oxidizing agent. The pollution emission can be further reduced with this. Also this can be used to increase the performance of a burner operating with the suggested method.

Further, according to the invention, a device is provided for low-emission, non-catalytic combustion of a liquid fuel with a mixing zone and a combustion zone located down current from the mixing zone, wherein there are connected to the mixing zone a means of separate introduction of the liquid or vaporized fuel in a non-ignitable state and a means of separate introduction of a gaseous oxidizing agent, and wherein the mixing zone is formed so that combustion is not possible even when the ignition temperature of the mixture is reached within the mixing zone.—The suggested device has extremely high performance dynamics. For instance, the performance can be varied in the range from 1 kW to 20 kW.

Due to the optimized embodiments of the device, reference is made to the description of the preceding features which can be correspondingly applied equally.

Figure 2:
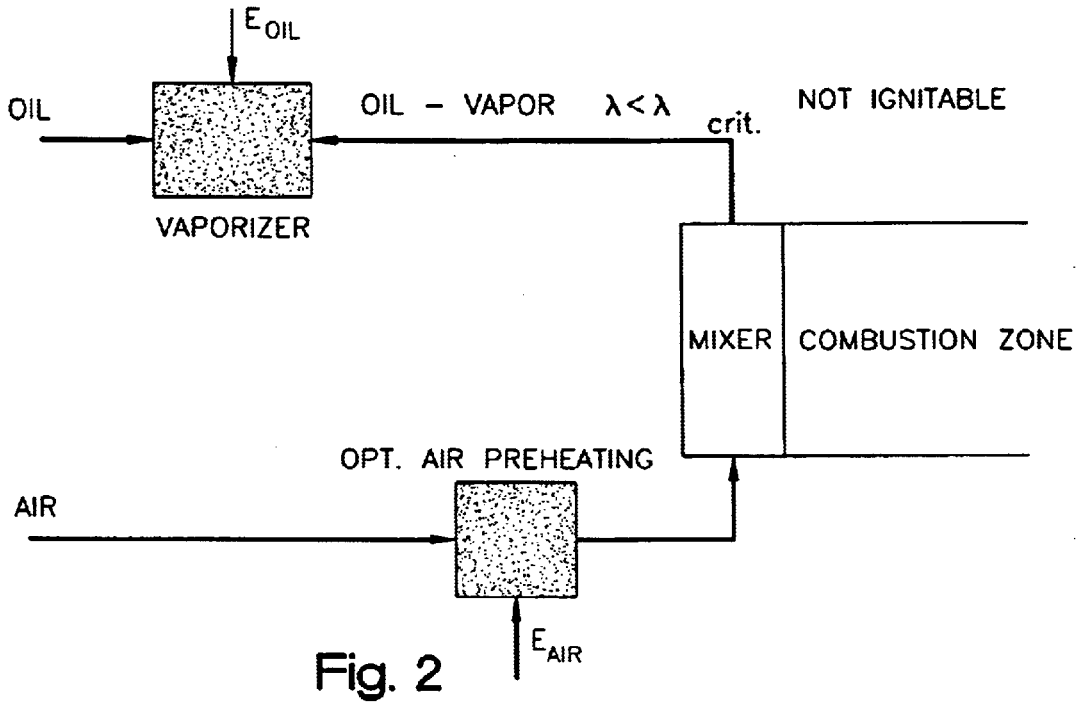
Figure 3:
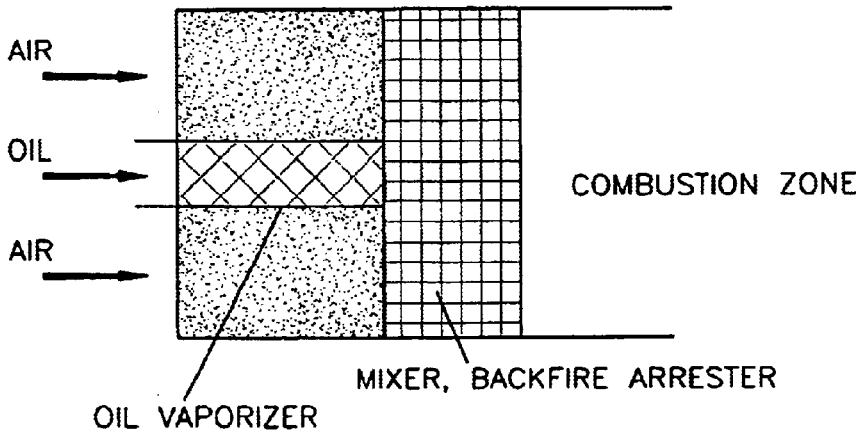
Figure 4:
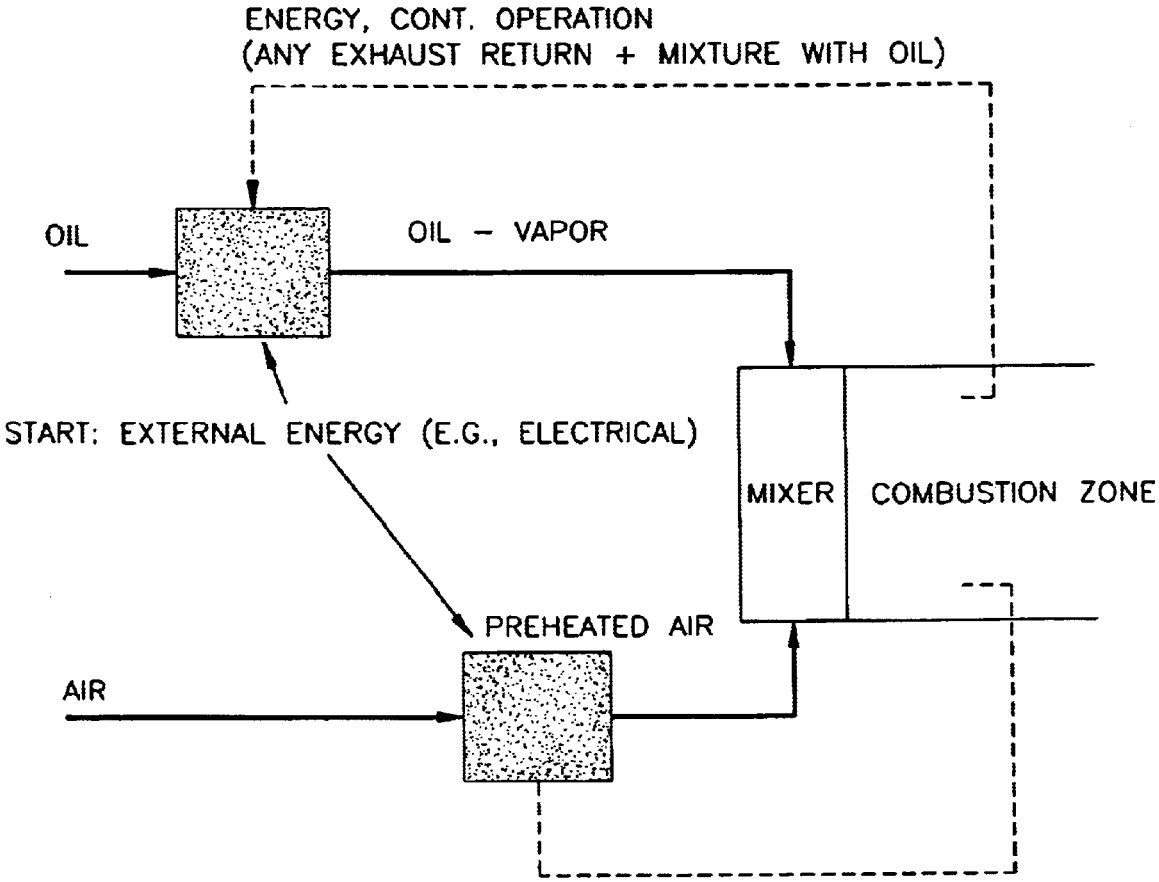
Figure 5:
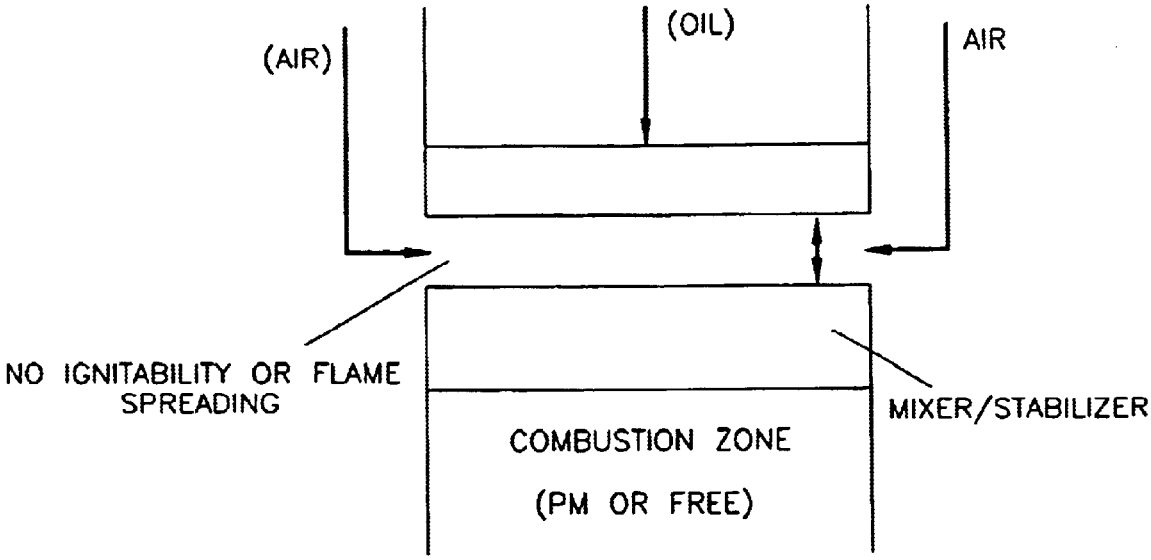
Figure 6:
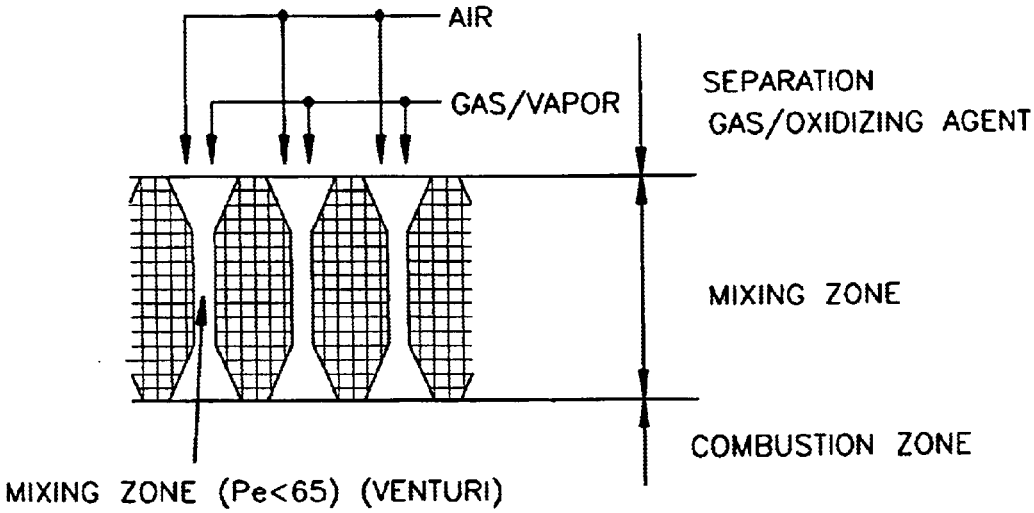

The invention will how be described in more detail using examples based on the drawing. It is shown:

FIG. 1 Schematically the function of a first device,

FIG. 2 schematically the function of a second device,

FIG. 3 schematically the function of a third device,

FIG. 4 schematically the function of a fourth device,

FIG. 5 schematically the function of a fifth device,

FIG. 6 schematically the function of a sixth device.

FIG. 1 schematically shows the function of a first device. A mixer is formed here, for example, from a porous ceramic with a Péclet number of less than 65. The mixer is opened towards a combustion zone. Otherwise the mixer is surrounded on all sides by a gas-proof housing. The housing is located immediately next to the surface of the porous ceramic. In the housing, connections are provided for a line for feeding in fuel and a line for feeding in a gaseous oxidizing agent such as air. A blower can be provided in the line for feeding in a gaseous oxidizing agent.

The fuel can be expanded in the mixer directly from the liquid state. It is also possible to feed to the mixer a mixture formed from the fuel and a non-ignitable gas. An ignitable mixture is generated in the mixer from the fuel and the gaseous oxidizing agent. Combustion of the ignitable mixture in the mixer is not possible due to the selected porosity, i.e., a Péclet number of less than 65. The mixture exits the mixer and is burned in the combustion zone provided down current.

The mass flow of both the gaseous oxidizing agent and the fuel can be regulated separately. The performance of the burner can thus be modulated in a wide range.

Further, low-emission combustion can be achieved in any selected performance range.

FIG. 2 shows a burner in accordance with FIG. 1. The fuel is made here with a device for vaporizing heating oil. It is formed from a non-ignitable oil vapor. The air number $\lambda$ or oil vapor is selected so that ignition capability does not exist.

The heating oil used here can be mixed with preheated heating oil $E_{oil}$ to accelerate vaporization. However, the used heating oil can also be preheated by electrical power, for example, or by the heat emitted by the exhaust fumes generated during combustion. In the same way, the used gaseous oxidizing agent such as air can be preheated with electrically preheated air or air warmed by exhaust-fume heat. It is also possible to mix both the used liquid fuel and the gaseous oxidizing agent with exhaust fumes and feed this to the mixer.

FIG. 3 shows a third version of a device provided by the invention. Here, a device for vaporization of liquid fuel is directly coupled to the mixer. Liquid fuel such as domestic heating oil is fed to a vaporization device made from a further porous element. The further porous element is heated by the heat of combustion. The liquid fuel is vaporized in the further porous element. The gas created by this enters the mixer which is positioned down current. Further, the gaseous oxidizing agent which is fed separately through the device for vaporization enters the mixer. The mixture is formed first in the mixer.

FIG. 4 shows a fourth version of a device provided by the invention. The device is similar to the device shown in FIG. 2. Exhaust is returned here. The returned exhaust is used for the vaporization of the liquid fuel as well as for the mixture of the thereby created vapor and for the preheating and mixture of the gaseous oxidizing agent.

FIG. 5 shows a fifth version of a device provided by the invention. With this, liquid fuel such as heating oil is vaporized in a further porous element. The thus created vapor enters a narrow slit and is mixed there with the fed in gaseous oxidizing agent or air. The width of the slit is selected so that an ignition cannot take place within the slit. The created premixture then enters the mixer which in turn can be formed from a porous element which has a Péclet number of less than 65. Down current of the mixer is provided in turn a combustion zone in which the homogenous mixture exiting the mixer is burned.

FIG. 6 shows a sixth device provided by the invention. With this, gaseous oxidizing agent such as air, and non-ignitable vapor is fed separately to a perforated plate. The jets of the feeder lines for fuel and gaseous oxidizing agent are arranged so that an ignition cannot take place up current from the mixing zone. With respect to its perforation diameter, the mixing zone itself is in turn formed so that an ignition of the created mixture also cannot take place therein. The mixture is burned in a combustion zone located after the mixing zones.

What is claimed is:

1. A method for low-emission, non-catalytic combustion of a liquid fuel, comprising the steps of:

a) separately introducing the liquid fuel in a non-ignitable state into a mixing zone, b) vaporizing the liquid fuel in the mixing zone, c) separately introducing a gaseous oxidizing agent into the mixing zone, d) mixing the fuel and the gaseous oxidizing agent in the mixing zone to create an ignitable mixture, wherein the mixing zone is formed so that combustion is not possible even when the ignition temperature of the mixture is reached within the mixing zone, and e) combusting the mixture in a combustion zone located down current from the mixing zone.

2. A method for low-emission, non-catalytic combustion of a liquid fuel, comprising the steps of:

a) vaporizing the liquid fuel in a vaporizer, b) separately introducing the vaporized fuel in a non-ignitable state into a mixing zone located down current from the vaporizer, c) separately introducing a gaseous oxidizing agent into the mixing zone, d) mixing the fuel and the gaseous oxidizing agent in the mixing zone to form an ignitable mixture, wherein the mixing zone is formed so that combustion is not possible even when the ignition temperature of the mixture is reached within the mixing zone, and e) combusting the mixture in a combustion zone located down current from the mixing zone.

3. The method as defined in claim 1, wherein the mixing zone has a Péclet number of less than 65.

4. The method as defined in claim 1, wherein the mixing zone is formed from a device selected from the group consisting of a perforated plate, a first porous element, and a narrow slit.

5. The method as defined in claim 4, wherein the mixture is fed to a second porous element which forms the combustion zone and is burned in its pore volume under formation of a flame.

6. The method as defined in claim 4, wherein the first and second porous elements are directly next to each other.

7. The method as defined in claim 5, wherein at least one of the perforated plate, the first porous element, and the second porous element are made of a ceramic material.

8. The method as defined in claim 7, comprising the further step of adding a non-oxidizing gas during vaporization in the vaporizer.

9. The method as defined in claim 1, comprising the further step of controlling at least one of a mass flow of the fuel fed to the mixing zone and a mass flow of the gaseous oxidizing agent.

10. The method as defined in claim 1, comprising the further step of preheating at least one of the fuel and the gaseous oxidizing agent.

11. The method as defined in claim 10, wherein said preheating step includes adding exhaust formed during combustion to at least one of the vaporized fuel and the gaseous oxidizing agent.

12. A device for low-emission, non-catalytic combustion of a liquid fuel, said device providing a mixing zone and a combustion zone, said combustion zone being located down current from the mixing zone, wherein means for separate introduction of the liquid or vaporized fuel in a non-ignitable state and means for separate introduction of a gaseous oxidizing agent are connected with the mixing zone, and wherein the mixing zone is formed so that combustion is not possible even when the ignition temperature of the mixture is reached within the mixing zone.

13. The device as defined in claim 12, wherein the mixing zone has a Péclet number of less than 65.

14. The device as defined in claim 12, wherein the mixing zone is formed from devices selected from the group consisting of a perforated plate, a first porous element, and a narrow slit.

15. The device as defined in claim 14, wherein the combustion zone is formed from a second porous element that permits combustion of the mixture.

16. The device as defined in claim 15, wherein at least one of the perforated plate, the first porous element, and the second porous element are made from a ceramic.

17. The device as defined in claim 15, wherein the first and the second porous element are directly next to each other.

18. The device as defined in claim 12, wherein a device for vaporizing the liquid fuel is provided up current from the mixing zone.

19. The device as defined in claim 18, wherein a device for adding a further non-oxidizing gas is connected with the vaporizing device.

20. The device as defined in claim 18, wherein the vaporizing device is part of the mixing zone.

21. The device as defined in claim 12, further comprising means for controlling at least one of a mass flow of the gas fed to the mixing zone and a mass flow of the gaseous oxidizing agent fed to the mixing zone.

22. The device as defined in claim 12, further comprising a device for preheating at least one of the gas and the gaseous oxidizing agent.

23. The method as defined in claim 2, comprising the further step of preheating at least one of the fuel and the gaseous oxidizing agent.

24. The method as defined in claim 2, wherein the mixing zone has a Péclet number of less than 65.

25. The method as defined in claim 2, wherein the mixing zone is formed from structures selected from the group consisting of a perforated plate, a first porous element, and a narrow slit.

26. The method as defined in claim 25, wherein the mixture is fed to a second porous element that forms the combustion zone and is burned in its pore volume under formation of a flame.

27. The method as defined in claim 26, wherein the first and second porous elements are directly next to each other.

28. The method as defined in claim 26, wherein at least one of the perforated plate, the first porous element, and the second porous element is made of a ceramic material.

29. The method as defined in claim 28, comprising the further step of adding a non-oxidizing gas during vaporization in the vaporizer.

30. The method as defined in claim 2, comprising the further step of controlling at least one of a mass flow of the fuel fed to the mixing zone and a mass flow of the gaseous oxidizing agent.

31. The method as defined claim 2, comprising the further step of preheating at least one of the fuel and the gaseous oxidizing agent.

32. The method as defined in claim 31, wherein the preheating step includes adding exhaust formed during combustion to at least one of the vaporized fuel and the gaseous oxidizing agent.

* * * * *